United States Patent [19]

Vineski

[11] Patent Number: 4,488,504

[45] Date of Patent: Dec. 18, 1984

[54] RELEASE AGENT MANAGEMENT SYSTEM FOR A HEAT AND PRESSURE FUSER APPARATUS

[75] Inventor: John E. Vineski, Rochester, N.Y.

[73] Assignee: Xerox Corporation, Stamford, Conn.

[21] Appl. No.: 461,089

[22] Filed: Jan. 26, 1983

[51] Int. Cl.[3] ..... G03G 15/20

[52] U.S. Cl. ..... 118/60; 118/70; 118/104; 432/60; 432/75

[58] Field of Search ..... 118/60, 70, 261, 104, 118/203; 432/60, 75

[56] References Cited

U.S. PATENT DOCUMENTS

| | | | |
|---|---|---|---|
| 4,045,164 | 8/1977 | Moser | 432/60 |
| 4,054,410 | 10/1977 | Murphy | 432/60 |
| 4,083,092 | 4/1978 | Imperial et al. | 29/132 |
| 4,087,676 | 5/1978 | Fukase | 219/216 |
| 4,149,485 | 4/1979 | Okamoto et al. | 118/60 |
| 4,170,957 | 10/1979 | Eddy et al. | 118/60 |
| 4,265,990 | 5/1981 | Stolka et al. | 430/59 |
| 4,359,963 | 11/1982 | Saito et al. | 432/60 X |

FOREIGN PATENT DOCUMENTS

| | | |
|---|---|---|
| 0006716 | 1/1980 | European Pat. Off . |
| 2527587 | 3/1976 | Fed. Rep. of Germany . |

*Primary Examiner*—Evan K. Lawrence

[57] ABSTRACT

A heat and pressure fuser apparatus for fixing toner images to a substrate. The apparatus is characterized by a low cost release agent management (RAM) system which delivers an excess (i.e. amount greater than required for offset prevention) quantity of silicone oil to the roll surface such that paper fibers and other contaminents are flushed from the surface of the fuser roll and conveyed into the release agent sump.

10 Claims, 2 Drawing Figures

RELEASE AGENT MANAGEMENT SYSTEM FOR A HEAT AND PRESSURE FUSER APPARATUS

Figure 1:
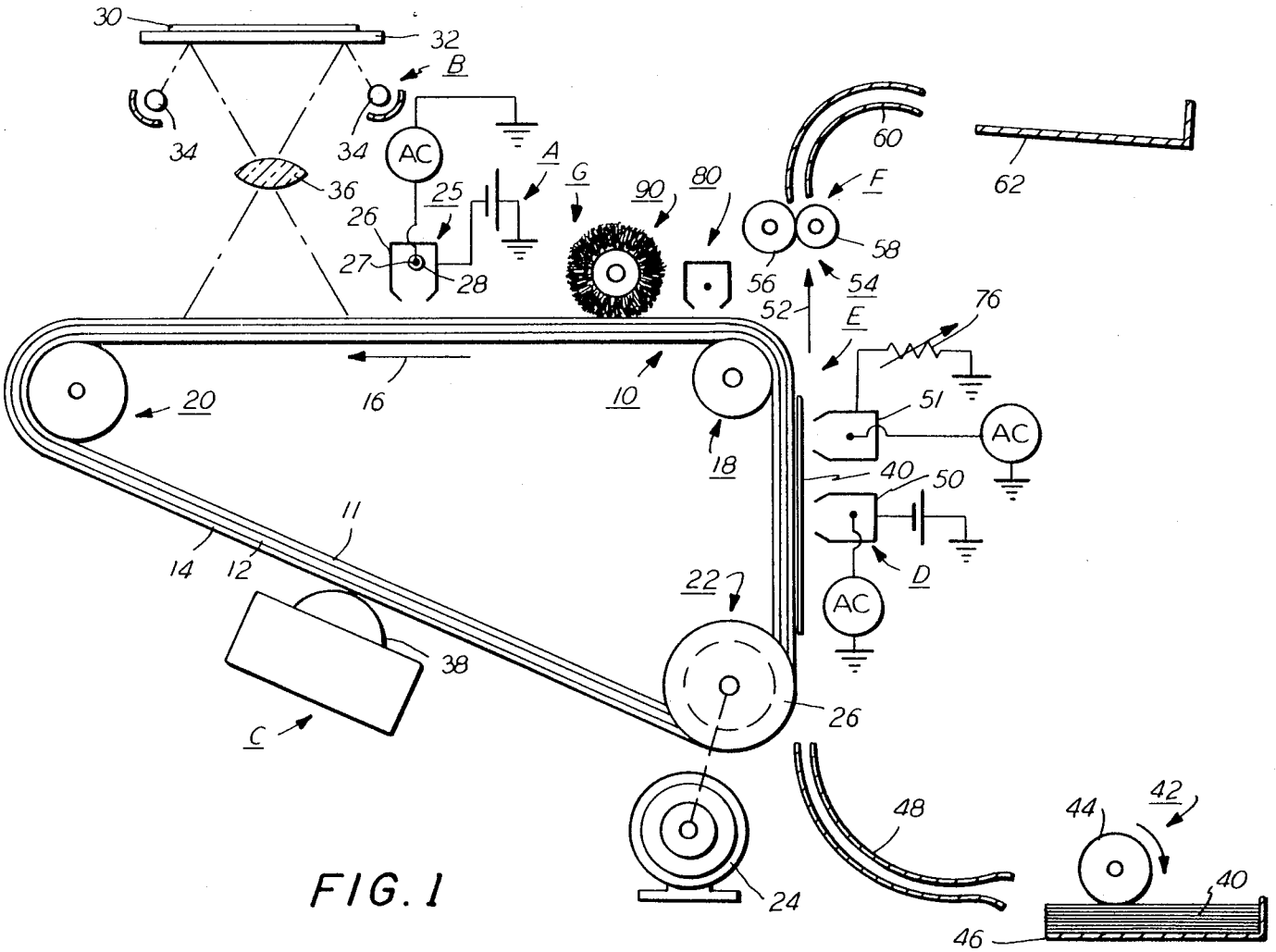

This invention relates, in general, to apparatus for fixing toner images to a substrate and, in particular, to a release agent management (RAM) system for a heat and pressure fuser.

The present invention is particularly useful in the field of xerography where images are electrostatically formed upon a member and developed with resinous powders known as toners, and thereafter fused or fixed onto sheets of paper or other substrates to which the powder images have been transferred. The resin-based powders or toners are generally heat and/or pressure softenable, such as those provided by toners which contain thermoplastic resins which have been used conventionally in a variety of commercially known methods.

In order to fuse images formed of the resinous powders or toners, it is necessary to heat the powder, to submit the powder to pressure or to use a combination of heat and pressure to fix or fuse the resinous powders or toners to a particular substrate. Temperature and/or pressure ranges will vary depending upon the softening range of the particular resin used in the toner. When heat is used in conjunction with pressure to fuse the images to a substrate, it is generally necessary to heat the toner powder in excess of about 180° C. or higher. Temperatures as high as 198° C. or even higher are not uncommon in commercially known methods and devices. Corresponding nip pressure is on the order of 100–200 psi.

It has long been recognized that one of the fastest and most positive methods of applying heat for fusing the powder image is by direct contact of the resin-based powder with a hot surface, such as a heated roll while pressure is being applied to the substrate to which the powder image is to be fused or fixed. But, in most instances, the powder image is tackified by the heat and/or pressure causing part of the image carried by the support material to stick the surface of the plate or roll or any other configuration used so that as the next sheet is advanced on the heated surface, the tackified image, partially removed from the first sheet, will partly transfer to the next sheet and at the same time part of the tackified image from said next sheet would adhere to the heated surface. This process is commonly referred to in the art as "offset", a term well known in the art.

The offset of toner onto the heated surface led to the development of improved methods and apparatus for fusing toner images. These improvements comprised fusing toner images by forwarding the sheet or web of substrate material bearing the image between two roll at least one of which was heated, the rolls contacting the image being provided with a thin (i.e. 0.0.001–0.003 inch) coating of tetrafluoroethylene resin and a silicone oil film to prevent toner offset. The outer surfaces of such rolls have also been fabricated of fluorinated ethylene propylene or silicone elastomers coated with silicone oil as well as silicone elastomers containing low surface energy fillers such as fluorinated organic polymers, and the like. The tendency of these rolls to pick up the toner generally requires some type of release fluid to be continuously applied to the surface of the roll to prevent such offset, and commonly known as silicone oils are generally well adapted for this purpose. Not only are the polydimethyl-siloxane fluids well known for this purpose but certain functional polyorganosiloxane release agents have also been described for this purpose. It is also well known to utilize fluids of low viscosity, for example, 100–200 centistokes as well as fluids of relatively high viscosity, for example, 12,000 centistokes to 60,000 centistokes and higher.

These fluids are applied to the surface of the heated roll by various devices known as release agent management (RAM) systems, the most common of which comprises a wick structure supported in physical contact with the fuser roll. It has long been recognized that the inclusion of a release agent management system as a part of a fuser design represents a significant percentage of the cost of fusing toner images. Obviously, it is desirable to provide a inexpensive RAM system for a heat and pressure fuser.

In accordance with the present invention, a RAM system is provided for applying silicone oil to the surface of a heated fuser roll. The system is characterized by low cost and the ability to flush away paper fibers from the fuser roll surface. The low cost stems from the elimination of a number of parts normally utilized in RAM systems, for example, the rather expensive oil dispensing wick which needs to be placed due to toner contamination which adversely affects the ability of the wick to dispense the silicone oil.

In the presently contemplated embodiment, the silicone oil is conveyed to the heated fuser roll and deposited on a predetermined area of it's surface and allowed to run across the roll surface until it contacts a metering blade where it spreads across the surface of the roll at the interface between the roll and the blade. To this end, a belt which can have an o-ring or flat configuration carries silicone oil from a sump containing a quantity of oil to the surface of the roll. The location where the oil is deposited is preferably at the center of the roll and above a metering blade which is adapted to meter the oil to the desired thickness. The amount of oil delivered to the roll and then to the interface between it and the blade is sufficient to not only coat the roll to the desired thickness for preventing toner offset but also to flush away paper fibers that accumulate at the interface. The blade is positioned such that the excess oil runs back into the sump thereby carrying the aforementioned paper fibers away from the fuser roll surface and into the sump where the fibers can be separated from the oil.

Figure 2A:
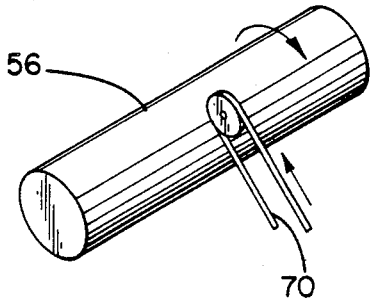

The present invention will be more fully understood when described in conjunction with the drawings wherein:

FIG. 1 is a schematic illustration of a printing machine incorporating the invention; and FIG. 2 is a perspective view of a release agent management system forming a part of the present invention;

FIG. 2*a* is a perspective view of an embodiment of the invention; and

Figure 2B:
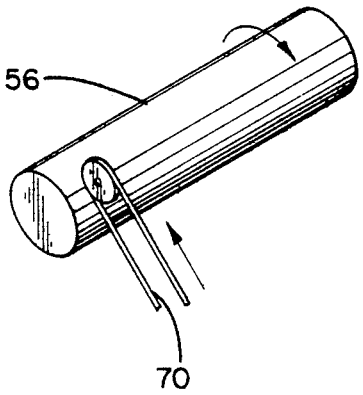

FIG. 2*b* is a perspective view of another embodiment of the invention.

Inasmuch as the art of electrophotography is well known, the various processing stations employed in the printing machine illustrated in the FIG. 1 will be described only briefly.

As shown in FIG. 1, the machine utilizes a photoconductive belt 10 which consists of an electrically conductive substrate 11, a charge generator layer 12 comprising photoconductive particles randomly dispersed in an electrically insulating organic resin and a charge transport layer 14 comprising a transparent electrically inactive polycarbonate resin having dissolved therein one or more diamines. A photoreceptor of this type is disclosed in U.S. Pat. No. 4,265,990 issued May 5, 1981 in the name of Milan Stolka et al, the disclosure of which is incorporated herein by reference. Belt 10 moves in the direction of arrow 16 to advance successive portions thereof sequentially through the various processing stations disposed about the path of movement thereof. Belt 10 is entrained about stripping roller 18, tension roller 20, and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as belt drive.

Belt 10 is maintained in tension by a pair of springs (not shown) resiliently urging tension roller 20 against belt 10 with the desired spring force. Both stripping roller 18 and tension roller 20 are rotatably mounted. These rollers are idlers which rotate freely as belt 10 moves in the direction of arrows 16.

With continued reference to FIG. 1, initially a portion of belt 10 passes through charging station A. At charging station A, a corona device, indicated generally by the reference numeral 25, charges the belt 10 to a relatively high, substantially uniform negative potential. A suitable corona generating device for negatively charging the photoconductive belt 10 comprises a conductive shield 26 and a dicorotron electrode comprising an elongated bare wire 27 and a relatively thick electrically insulating layer 28 having a thickness which precludes a net d.c. corona current when an a.c. voltage is applied to the corona wire and when the shield and the photoconductive surface are at the same potential. Stated differently, in the absence of an external field supplied by either a bias applied to the shield or a charge on the photoreceptor there is substantially no net d.c. current flow.

Next, the charged portion of photoconductive belt is advanced through exposure station B. At exposure station B, an original document 30 is positioned facedown upon transparent platen 32. Lamps 34 flash light rays onto original document 30. The light rays reflected from original document 30 form light images which are transmitted through lens 36. The light images are projected onto the charged portion of the photoconductive belt to selectively dissipate the charge thereon. This records an electrostatic latent image on the belt which corresponds to the informational area contained within original document 30. Alternatively, the exposure station B could contain an electrographic recording device for placing electrostatic images on the belt 10 in which case, the corona device 25 would be unnecessary.

Thereafter, belt 10 advances the electrostatic latent image to development station C. At development station C, a magnetic brush developer roller 38 advances a developer mix (i.e. toner and carrier granules) into contact with the electrostatic latent image. The latent image attracts the toner particles from the carrier granules thereby forming toner powder images on the photoconductive belt.

Belt 10 then advances the toner powder image to transfer station D. At transfer station D, a sheet of support material 40 is moved into contact with the toner powder images. The sheet of support material is advanced to transfer station D by a sheet feeding apparatus 42. Preferably, sheet feeding apparatus 42 includes a feed roll 44 contacting the upper sheet of stack 46. Feed roll 44 rotates so as to advance the uppermost sheet from stack 46 into chute 48. Chute 48 directs the advancing sheet of support material into contact with the belt 10 in timed sequence so that the toner powder image developed thereon contacts the advancing sheet of support material at transfer station D.

Transfer station D includes a corona generating device 50 which sprays negative ions onto the backside of sheet 40 so that the toner powder images which comprise positive toner particles are attracted from photoconductive belt 10 to sheet 40. For this purpose, approximately 50 microamperes of negative current flow to the copy sheet is effected by the application of a suitable corona generating voltage and proper bias.

Subsequent to transfer the image sheet moves past a detack corona generating device 51 positioned at a detack station E. At the detack station the charges placed on the backside of the copy sheet during transfer are partially neutralized. The partial neutralization of the charges on the backside of the copy sheet thereby reduces the bonding forces holding it to the belt 10 thus enabling the sheet to be stripped as the belt moves around the rather sharp bend in the belt provided by the roller 18. After detack, the sheet continues to move in the direction of arrow 52 onto a conveyor (not shown) which advances the sheet to fusing station F.

Fusing station F includes a fuser assembly, indicated generally by the reference numeral 54, which permanently affixes the transferred toner powder images to sheet 40. Preferably, fuser assembly 54 includes a heated fuser member in the form of a roller 56 adapted to be pressure engaged with a backup roller 58. Sheet 40 passes between fuser roller 56 and backup roller 58 with the toner powder images contacting fuser roller 56. In this manner, the toner powder image is permanently affixed to sheet 40. After fusing, chute 60 guides the advancing sheet 40 to catch tray 62 for removal from the printing machine by the operator.

The fuser roller may comprise an outer coating or layer 64 of an elastomeric material such as silicone rubber, Viton (a trademark of E. I. DuPont or a polymer such as Teflon (also a trademark of E. I. DuPont). Each of these materials have been used for xerographic fusers because of their abhesive (i.e. non-adhesive) property. Even though such materials have a low affinity for toner, it has been customary to apply silicone oil thereto to thereby enhance the abhesive nature of the surface.

In accordance with the present invention, there is provided a RAM system for applying silicone oil to the fuser roll surface which system is not only inexpensive but is effective in minimizing the paper fiber problem usually associated with roll fusers. To this end, as viewed in FIG. 2, a quantity of silicone oil 66 is contained in a sump 68. The oil preferably has a viscosity on the order of 200 centistokes and may be conventional silicone oil or functional silicone oil. It is preferable to use the functional oil with the Viton particularly when the Viton is lead oxide filled while conventional silicone oil is preferred for use on silicone rubber and Teflon.

A belt 70 is preferably fabricated from Viton and has a circular cross section when it is of o-ring construction and a rectangular cross-section when the belt is flat. The belt is used to convey the silicone oil from the sump to a limited area of the fuser roll surface. In this regard, the RAM system of the present invention differs from prior art devices such as those that employ a wick which contacts the fuser roll across its entire length and then conveys oil across the entire working length of the fuser oil. The oil which has a relatively low viscosity runs down the fuser roll surface to the interface between the roll and a metering blade 72 where the oil spreads across the fuser roll surface. In the preferred embodiment of the invention the belt delivers the oil at approximately the center of the roll. Thus the oil spreads outwardly from the center of the roll towards the ends of the metering blade where it flows over the top of the blade and back into the sump. The oil may be filtered during its return to the sump in order to remove any contaminent, such as paper fiber which it has picked up from the fuser roll surface.

As can now be appreciated, the RAM system disclosed hereinabove is simple in construction and, therefore, relatively inexpensive compared to prior art devices which usually comprise a replaceable wick and an oil pumping arrangement for conveying the oil from a storage area to the wick. By eliminating the relatively costly wick and by using the oil to flush away paper fibers a more reliable and less expensive RAM system is provided.

I claim:

1. Release agent management apparatus for applying a predetermined quantity of silicone oil to the surface of a fuser roll, said apparatus comprising:

means for conveying a quantity of silicone oil from a sump to the surface of said fuser roll and depositing said silicone oil on a limited area only at the center of said fuser roll; and means for effecting the spreading of said silicone oil over the working area of said fuser roll.

2. Apparatus according to claim 1 wherein said spreading means is adapted to meter said silicone oil to a predetermined thickness on the surface of said fuser roll.

3. Apparatus according to claim 2 wherein said spreading means comprises a blade contacting the surface of said fuser roll.

4. Apparatus according to claim 3 wherein said oil conveying means is adapted to deliver a predetermined quantity of oil to said fuser roll at a location above the location where said blade contacts said fuser roll whereby the oil is carried by the fuser roll to the interface between said blade and said fuser roll.

5. Apparatus according to claim 4 wherein said blade is adapted to direct excess oil back into said sump.

6. Apparatus according to claim 5 wherein said oil conveying means comprises an endless belt member having a circular cross section.

7. Apparatus according to claim 5 wherein said oil conveying means comprises an endless belt member having a rectangular cross section.

8. Apparatus according to claim 6 wherein said endless member is fabricated from an elastomeric material.

9. Apparatus according to claim 7 wherein said endless member is fabricated from an elastomeric material.

10. Release agent management apparatus for applying a predetermined quantity of silicone oil to the surface of a fuser roll, said apparatus comprising:

means for conveying a quantity of silicone oil from a sump to the surface of said fuser roll and depositing said silicone oil on a limited area lying between the center of the fuser roll and one end thereof of said fuser roll than the other end; and means for effecting the spreading of said silicone oil over the working area of said fuser roll.

* * * * *